US008661706B2

(12) United States Patent
Bellinger

(10) Patent No.: US 8,661,706 B2
(45) Date of Patent: Mar. 4, 2014

(54) METHOD FOR DETERMINING LOAD SIZE IN A CLOTHES DRYER USING AN INFRARED SENSOR

(75) Inventor: Ryan R. Bellinger, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/555,227

(22) Filed: Jul. 23, 2012

(65) Prior Publication Data

US 2012/0285035 A1 Nov. 15, 2012

Related U.S. Application Data

(63) Continuation of application No. 12/641,519, filed on Dec. 18, 2009, now Pat. No. 8,245,415.

(51) Int. Cl.
*F26B 3/00* (2006.01)

(52) U.S. Cl.
USPC ..... 34/486; 34/491; 34/495; 8/137; 68/12.04

(58) Field of Classification Search
USPC ..... 34/486, 491, 495, 499, 520; 68/12.01, 68/12.02, 12.04, 12.18; 8/137, 159, 636
See application file for complete search history.

(56) References Cited

U.S. PATENT DOCUMENTS

| | | | | |
|---|---|---|---|---|
| 2,142,042 | A | 12/1938 | Bowdoin et al. | |
| 3,161,481 | A * | 12/1964 | Edwards | 34/527 |
| 3,169,838 | A * | 2/1965 | Kripke | 34/528 |
| 3,273,256 | A * | 9/1966 | Behrens | 34/546 |
| 3,417,480 | A | 12/1968 | Thunander | |
| 3,702,030 | A | 11/1972 | Janke | |
| 4,006,535 | A | 2/1977 | Nelson | |
| 4,041,614 | A | 8/1977 | Robinet | |
| 4,231,166 | A | 11/1980 | McMillan | |
| 4,275,508 | A | 6/1981 | Jones | |
| 4,642,908 | A | 2/1987 | Brenner | |
| 4,733,479 | A * | 3/1988 | Kaji et al. | 34/446 |
| 4,738,034 | A * | 4/1988 | Muramatsu et al. | 34/524 |
| 4,763,425 | A * | 8/1988 | Grennan | 34/552 |
| 5,172,490 | A | 12/1992 | Tatsumi et al. | |
| 5,245,764 | A | 9/1993 | Sung | |
| 5,276,978 | A | 1/1994 | Hopkins et al. | |
| 5,291,667 | A | 3/1994 | Joslin et al. | |
| 5,396,715 | A | 3/1995 | Smith | |
| 5,560,124 | A | 10/1996 | Hart et al. | |

(Continued)

FOREIGN PATENT DOCUMENTS

| | | | |
|---|---|---|---|
| DE | 19961459 | A1 | 7/2001 |
| DE | 102006025952 | A1 | 12/2007 |

(Continued)

OTHER PUBLICATIONS

German Search Report for corresponding DE102010017232, Dec. 22, 2011.

(Continued)

*Primary Examiner* — Steve M Gravini

(57) ABSTRACT

A method for controlling the operation of a clothes dryer by determining a load size estimation based on at least one of a temperature variation of the laundry load and a delay time wherein the delay time is a time it takes for the temperature variation to satisfy a predetermined threshold.

29 Claims, 12 Drawing Sheets

(56) References Cited

U.S. PATENT DOCUMENTS

| | | | | |
|---|---|---|---|---|
| 5,651,192 | A | 7/1997 | Horwitz | |
| 5,724,750 | A | 3/1998 | Burress | |
| 5,755,041 | A | 5/1998 | Horwitz | |
| 5,899,005 | A | 5/1999 | Chen et al. | |
| 5,953,831 | A | 9/1999 | Yu | |
| 5,958,494 | A | 9/1999 | Tidland et al. | |
| 6,047,486 | A | 4/2000 | Reck et al. | |
| 6,067,729 | A | 5/2000 | Willis | |
| 6,079,121 | A * | 6/2000 | Khadkikar et al. | 34/528 |
| 6,122,840 | A | 9/2000 | Chbat et al. | |
| 6,158,148 | A | 12/2000 | Krausch | |
| 6,223,452 | B1 | 5/2001 | Hamand | |
| 6,401,357 | B1 | 6/2002 | Smith et al. | |
| 6,519,871 | B2 | 2/2003 | Gardner et al. | |
| 6,584,633 | B2 | 7/2003 | Chute et al. | |
| 6,715,216 | B1 | 4/2004 | Salameh et al. | |
| 6,751,888 | B2 | 6/2004 | Lueckenbach | |
| 6,757,988 | B2 | 7/2004 | Bruntz et al. | |
| 6,784,997 | B2 | 8/2004 | Lorenz et al. | |
| 6,840,069 | B2 | 1/2005 | France et al. | |
| 6,898,951 | B2 | 5/2005 | Severns et al. | |
| 7,020,982 | B2 | 4/2006 | Park et al. | |
| 7,043,855 | B2 | 5/2006 | Heilman et al. | |
| 7,257,905 | B2 | 8/2007 | Guinibert et al. | |
| 7,448,145 | B2 | 11/2008 | Kim | |
| 7,478,486 | B2 | 1/2009 | Wunderlin et al. | |
| 7,644,513 | B2 | 1/2010 | Bae et al. | |
| 7,665,227 | B2 * | 2/2010 | Wright et al. | 34/339 |
| 7,765,715 | B2 | 8/2010 | Kim | |
| 7,900,374 | B2 * | 3/2011 | Bae et al. | 34/491 |
| 7,908,766 | B2 | 3/2011 | Ahn et al. | |
| 7,921,578 | B2 * | 4/2011 | McAllister et al. | 34/597 |
| 7,942,025 | B1 | 5/2011 | Musone | |
| 8,015,726 | B2 | 9/2011 | Carow et al. | |
| 8,234,796 | B2 * | 8/2012 | Dreossi et al. | 34/491 |
| 8,245,415 | B2 * | 8/2012 | Bellinger | 34/389 |
| 2002/0004995 | A1 | 1/2002 | France et al. | |
| 2002/0174564 | A1 | 11/2002 | England | |
| 2003/0101617 | A1 | 6/2003 | Prajescu et al. | |
| 2004/0006831 | A1 * | 1/2004 | Kim et al. | 8/159 |
| 2004/0006886 | A1 | 1/2004 | Lee et al. | |
| 2004/0119972 | A1 | 6/2004 | Smit-Kingma et al. | |
| 2004/0226187 | A1 | 11/2004 | Bruntz et al. | |
| 2005/0086826 | A1 | 4/2005 | Frushtick | |
| 2005/0097773 | A1 | 5/2005 | Gardner | |
| 2006/0191161 | A1 | 8/2006 | Wunderlin et al. | |
| 2006/0260064 | A1 | 11/2006 | Luckman et al. | |
| 2007/0193056 | A1 | 8/2007 | Switalski | |
| 2007/0209228 | A1 | 9/2007 | Meerpohl et al. | |
| 2007/0214678 | A1 | 9/2007 | Son et al. | |
| 2008/0120868 | A1 | 5/2008 | Morrison et al. | |
| 2009/0044422 | A1 | 2/2009 | Moschuetz et al. | |
| 2009/0071032 | A1 | 3/2009 | Kreutzfeldt et al. | |
| 2009/0126220 | A1 | 5/2009 | Nawrot et al. | |
| 2009/0159301 | A1 | 6/2009 | Chatot et al. | |
| 2009/0223082 | A1 | 9/2009 | Baek et al. | |
| 2009/0255142 | A1 | 10/2009 | Brown | |
| 2009/0272004 | A1 | 11/2009 | Chernetski et al. | |
| 2010/0000022 | A1 | 1/2010 | Hendrickson et al. | |
| 2010/0050464 | A1 | 3/2010 | Krzelowski et al. | |
| 2010/0115785 | A1 * | 5/2010 | Ben-Shmuel et al. | 34/260 |
| 2010/0126038 | A1 * | 5/2010 | Dreossi et al. | 34/572 |
| 2010/0139366 | A1 | 6/2010 | Krausch | |
| 2010/0205824 | A1 | 8/2010 | Ashrafzadeh et al. | |
| 2011/0047812 | A1 | 3/2011 | Sugimoto et al. | |
| 2011/0146101 | A1 | 6/2011 | Bellinger et al. | |
| 2011/0308103 | A1 | 12/2011 | Bellinger et al. | |
| 2012/0110869 | A1 | 5/2012 | Bellinger et al. | |
| 2012/0285035 | A1 * | 11/2012 | Bellinger | 34/380 |
| 2013/0091726 | A1 | 4/2013 | Kim et al. | |

FOREIGN PATENT DOCUMENTS

| | | | |
|---|---|---|---|
| DE | 102008008797 | A1 | 8/2009 |
| DE | 102010017232 | A1 | 6/2011 |
| DE | 102010017234 | A1 | 6/2011 |
| EP | 0312065 | A1 | 4/1989 |
| EP | 0679754 | A2 | 11/1995 |
| EP | 0915199 | A1 | 5/1999 |
| EP | 1279760 | A | 1/2003 |
| EP | 1983086 | A2 | 10/2008 |
| EP | 2022893 | A2 | 2/2009 |
| FR | 2894996 | A1 | 6/2007 |
| JP | 02249598 | A | 10/1990 |
| JP | 05177091 | A | 7/1993 |
| JP | 5177095 | A | 7/1993 |
| JP | 5200194 | A | 8/1993 |
| JP | 6126099 | A | 5/1994 |
| JP | 7178293 | A | 7/1995 |
| JP | 10290898 | A | 11/1998 |
| JP | 2009078059 | A | 4/2009 |
| JP | 2009131786 | A | 6/2009 |
| JP | 2012228501 | A | 11/2012 |
| KR | 20030012417 | A | 2/2003 |
| WO | 0194686 | A2 | 12/2001 |
| WO | 2007057360 | A1 | 5/2007 |
| WO | 2007141139 | A1 | 12/2007 |
| WO | 2008000812 | A1 | 1/2008 |
| WO | 2008049534 | A1 | 5/2008 |
| WO | 2008148844 | A2 | 12/2008 |

OTHER PUBLICATIONS

German Search Report for Counterpart DE102012105829, Jun. 6, 2013.

* cited by examiner

METHOD FOR DETERMINING LOAD SIZE IN A CLOTHES DRYER USING AN INFRARED SENSOR

CROSS REFERENCE TO RELATED APPLICATIONS

This application is a continuation of U.S. patent application Ser. No. 12/641,519, filed Dec. 18, 2009, now U.S. Pat. No. 8,245,415, issued Aug. 21, 2012, which is hereby incorporated by reference.

BACKGROUND OF THE INVENTION

Laundry treating appliances, such as clothes dryers, refreshers, and non-aqueous systems, may have a configuration based on a rotating drum that defines a treating chamber in which laundry items are placed for treating. The laundry treating appliance may have a controller that implements a number of pre-programmed cycles of operation having one or more operating parameters.

In most clothes dryers, one or more operating parameters may be set based on the laundry load size. In some clothes dryers, the user manually inputs a qualitative laundry load size (extra-small, small, medium, large, extra-large, etc.). In other clothes dryers, the controller automatically determines the laundry load size.

SUMMARY OF THE INVENTION

A method for controlling the operation of, or a cycle of operation for, a clothes dryer having a rotatable drum defining a drying chamber and an infrared temperature sensor directed toward the drying chamber. The method or cycle of operation according to one embodiment of the invention includes taking a plurality of temperature readings over time of the load of laundry with the infrared sensor, determining a temperature variation in the plurality of temperature readings, and determining a load size estimation based on at least one of the temperature variation and a delay time wherein the delay time is a time it takes for the temperature variation to satisfy a predetermined threshold.

DESCRIPTION OF EMBODIMENTS OF THE INVENTION

Figure 1:
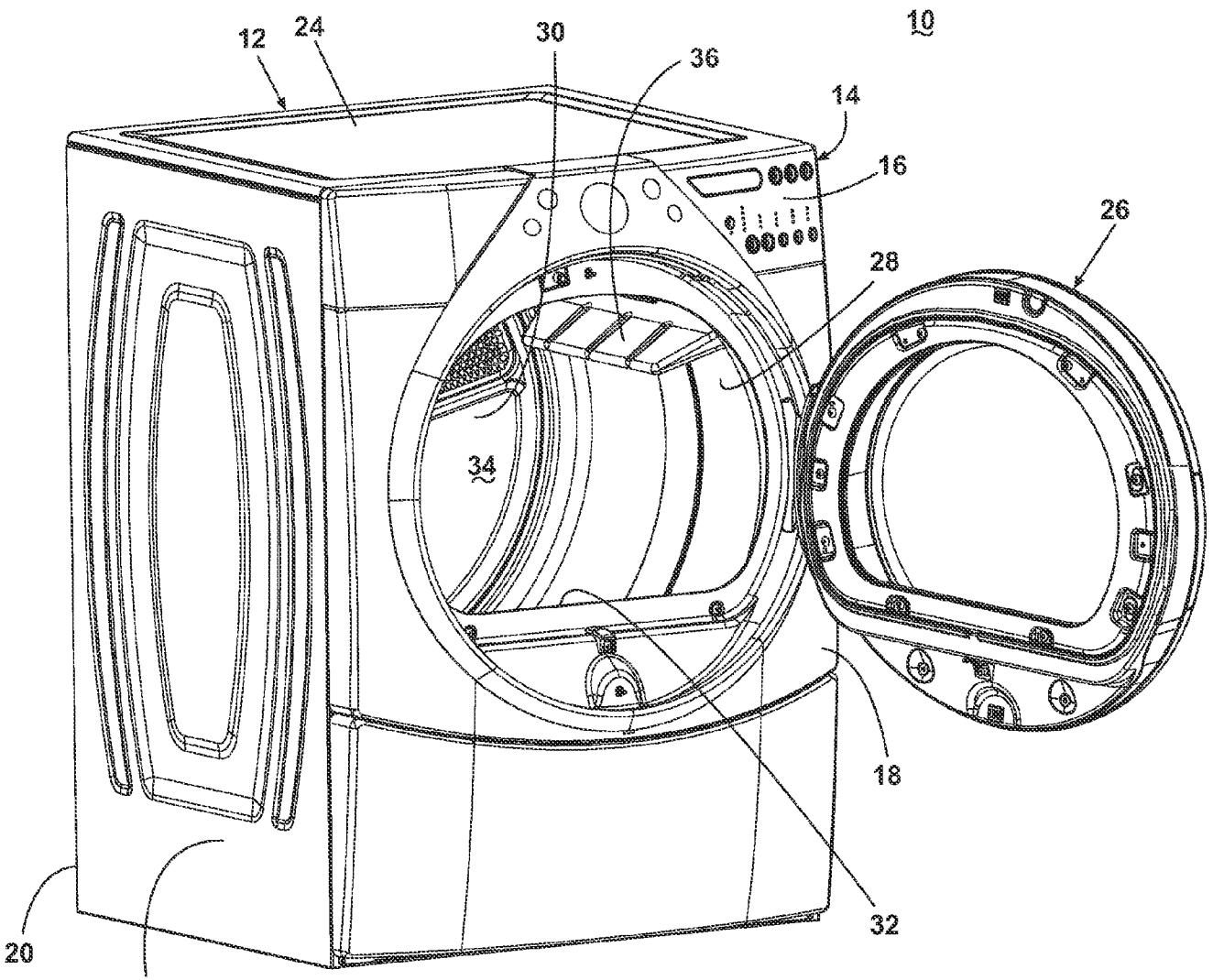
FIG. 1 is a front perspective view of a laundry treating appliance according to one embodiment of the invention in the form of a clothes dryer with a treating chamber.

FIG. 1 illustrates one embodiment of a laundry treating appliance in the form of a clothes dryer 10 according to the invention. While the laundry treating appliance is illustrated as a clothes dryer 10, the laundry treating appliance according to the invention may be another appliance which performs a cycle of operation on laundry, non-limiting examples of which include a combination washing machine and dryer; a tumbling or stationary refreshing/revitalizing machine; an extractor; a non-aqueous washing apparatus; and a revitalizing machine. The clothes dryer 10 described herein shares many features of a traditional automatic clothes dryer, which will not be described in detail except as necessary for a complete understanding of the invention.

As illustrated in FIG. 1, the clothes dryer 10 may include a cabinet 12 in which is provided a controller 14 that may receive input from a user through a user interface 16 for selecting a cycle of operation and controlling the operation of the clothes dryer 10 to implement the selected cycle of operation. The cabinet 12 may be defined by a front wall 18, a rear wall 20, and a pair of side walls 22 supporting a top wall 24. A door 26 may be hingedly mounted to the front wall 18 and may be selectively moveable between opened and closed positions to close an opening in the front wall 18, which provides access to the interior of the cabinet 12.

A rotatable drum 28 may be disposed within the interior of the cabinet 12 between opposing stationary rear and front bulkheads 30 and 32, which collectively define a drying or treating chamber 34 having an open face that may be selectively closed by the door 26. The drum 28 may include at least one baffle or lifter 36. In most clothes dryers, there are multiple lifters. The lifters 36 may be located along the inner surface of the drum 28 defining an interior circumference of the drum 28. The lifters 36 may facilitate movement of laundry within the drum 28 as the drum 28 rotates.

Figure 2:
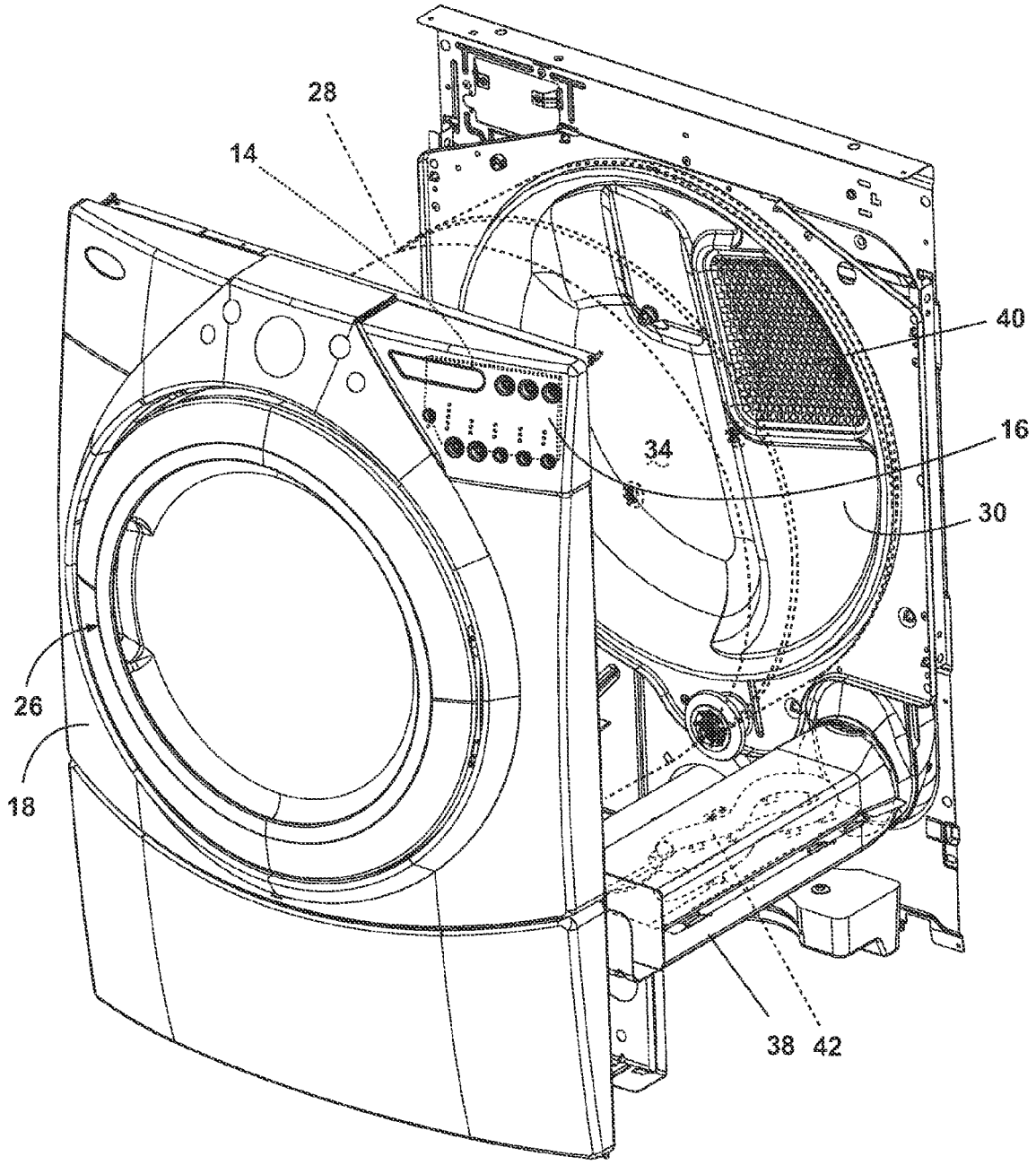
FIG. 2 is a front partial perspective view of the clothes dryer of FIG. 1 with portions of the cabinet removed for clarity.

Referring to FIG. 2, an air flow system for the clothes dryer 10 supplies air to the treating chamber 34 and then exhausts air from the treating chamber 34. The air flow system may have an air supply portion that may be formed in part by an inlet conduit 38, which has one end open to the ambient air and another end fluidly coupled to an inlet grill 40, which may be in fluid communication with the treating chamber 34. A heating element 42 may lie within the inlet conduit 38 and may be operably coupled to and controlled by the controller 14. If the heating element 42 is turned on, the supplied air will be heated prior to entering the drum 28.

Figure 3:
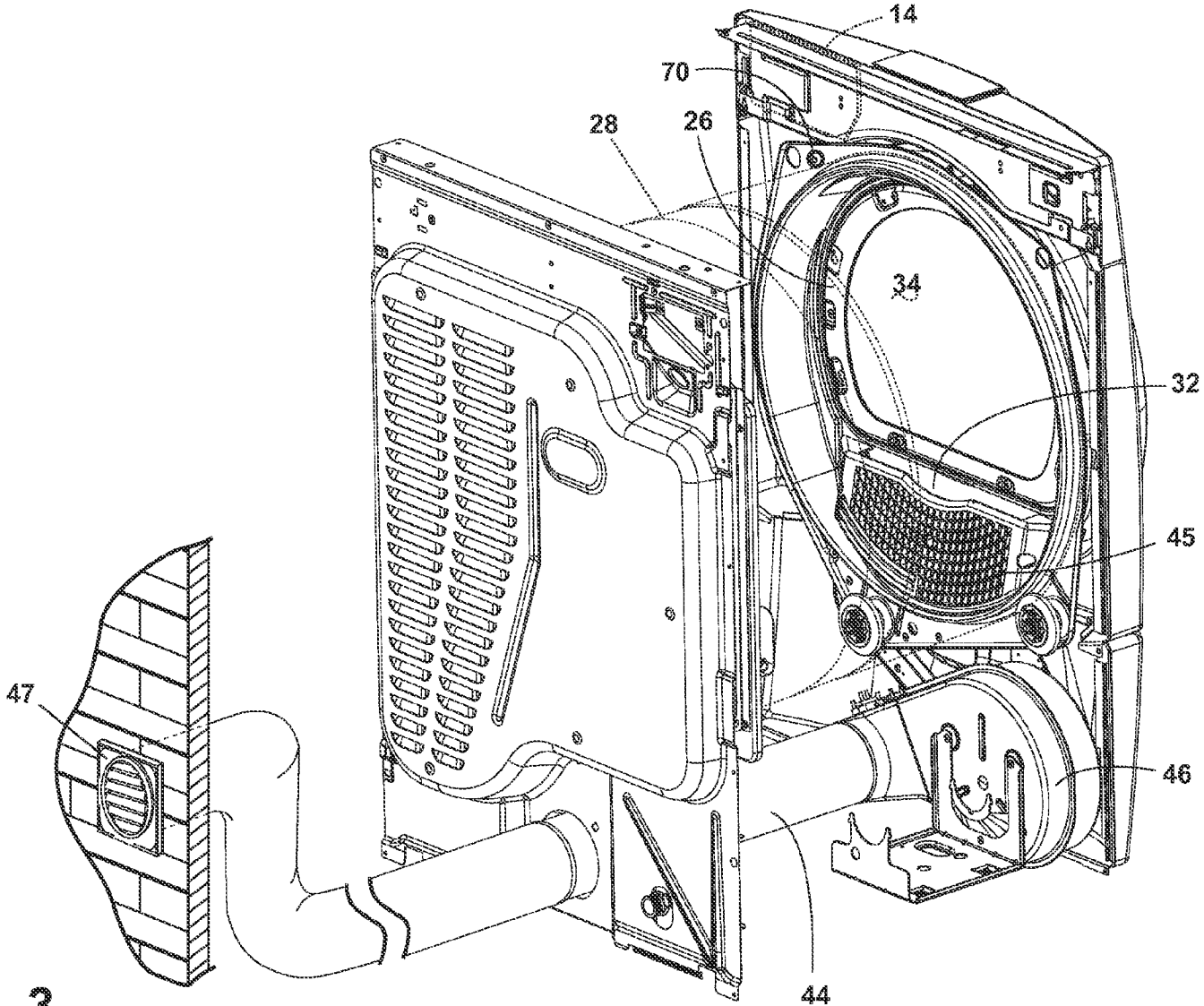
FIG. 3 is rear partial perspective view of the clothes dryer of FIG. 1 with portions of the cabinet removed for clarity, with an infrared (IR) sensor shown within the clothes dryer.

Referring to FIG. 3, the air supply system may further include an air exhaust portion that may be formed in part by an exhaust conduit 44 and lint trap 45, which are fluidly coupled by a blower 46. The blower 46 may be operably coupled to and controlled by the controller 14. Operation of the blower 46 draws air into the treating chamber 34 and exhausts air from the treating chamber 34 through the exhaust conduit 44. The exhaust conduit 44 may be fluidly coupled with a household exhaust duct 47 for exhausting the air from the treating chamber 34 to the outside environment.

Figure 4:
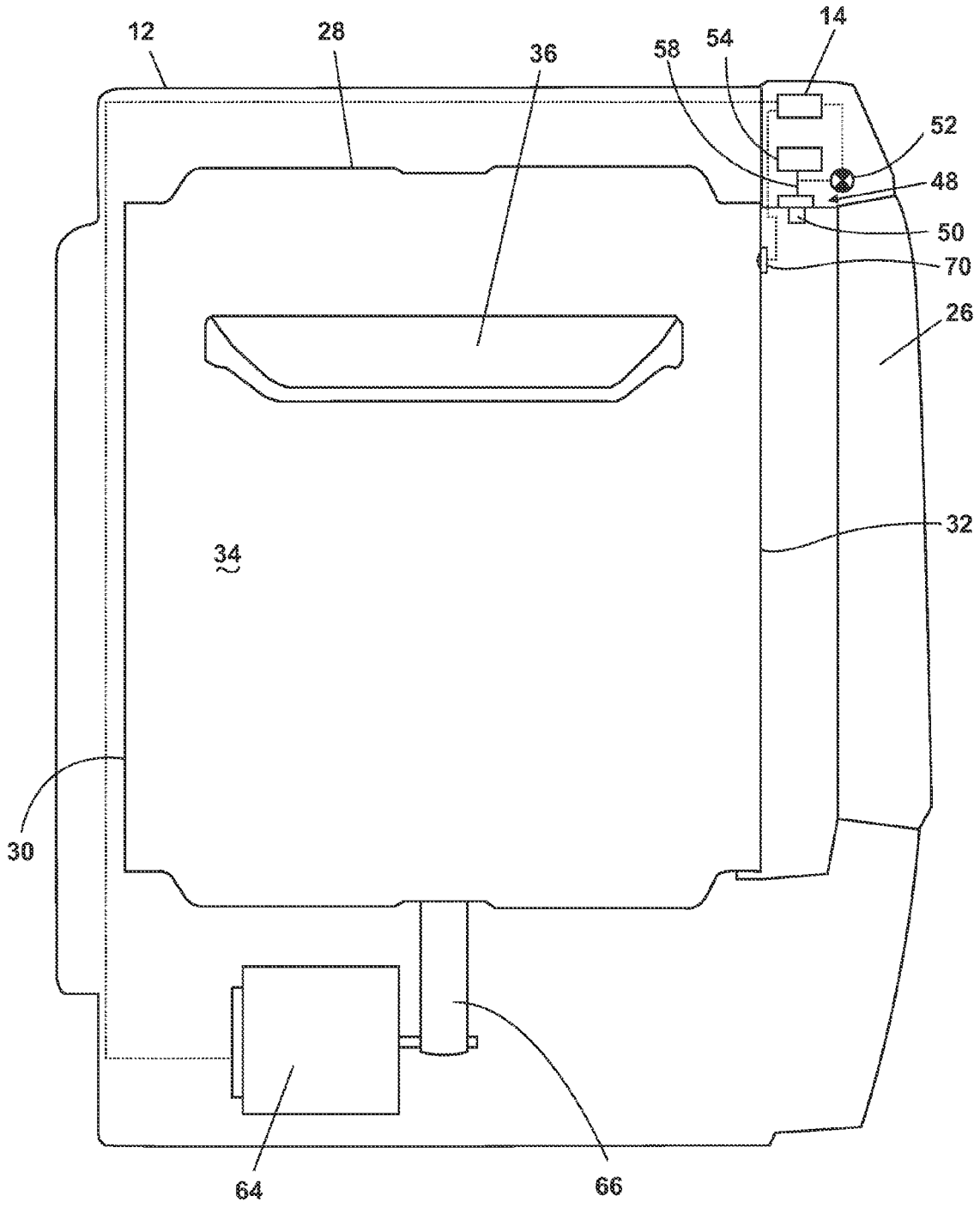
FIG. 4 is a schematic side view of the clothes dryer of FIG. 1 having an infrared temperature sensor for determining the temperature of the treating chamber and/or of a load of laundry within the treating chamber.

Referring to FIG. 4, the clothes dryer 10 may optionally have a dispensing system 48 for dispensing treating chemistries, including without limitation water or steam, into the treating chamber 34, and thus may be considered to be a dispensing dryer. The dispensing system 48 may include a reservoir 54 capable of holding treating chemistry and a dispenser 50 that fluidly couples with the reservoir 54 through a dispensing line 58. The treating chemistry may be delivered to the dispenser 50 from the reservoir 54, and the dispenser 50 may dispense the chemistry into the treating chamber 34. The dispenser 50 may be positioned to direct the treating chemistry at the inner surface of the drum 28 so that laundry may contact and absorb the chemistry, or to dispense the chemistry directly onto the laundry in the treating chamber 34. The type of dispenser 50 is not germane to the invention. A chemistry meter 52 may electronically couple, through a wired or wireless connection, to the controller 14 to control the amount of treating chemistry dispensed.

As is typical in a clothes dryer, the drum 28 may be rotated by a suitable drive mechanism, which is illustrated as a motor 64 and a coupled belt 66. The motor 64 may be operably coupled to the controller 14 to control the rotation of the drum 28 to complete a cycle of operation. Other drive mechanisms, such as direct drive, may also be used.

The clothes dryer 10 may also have a treating chamber temperature sensor in the form of an infrared (IR) sensor 70 to determine the temperature of the treating chamber 34 and/or of the load of laundry within the treating chamber 34. The IR sensor 70 measures the IR radiation of objects in its field of view; as the IR radiation increases, so does the object's temperature. One example of a suitable IR sensor 70 is a thermopile. The IR sensor 70 may be located on either of the rear or front bulkhead 30, 32 or in the door 26, and may be aimed toward an expected location of a load of laundry within the treating chamber 34. As illustrated, the IR sensor 70 is located in a top portion of the front bulkhead 32 and is aimed generally downwardly within the treating chamber 34. It may be readily understood that the IR sensors 70 may be provided in numerous other locations depending on the particular structure of the clothes dryer 10 and the desired position for obtaining a temperature reading.

Figure 5:
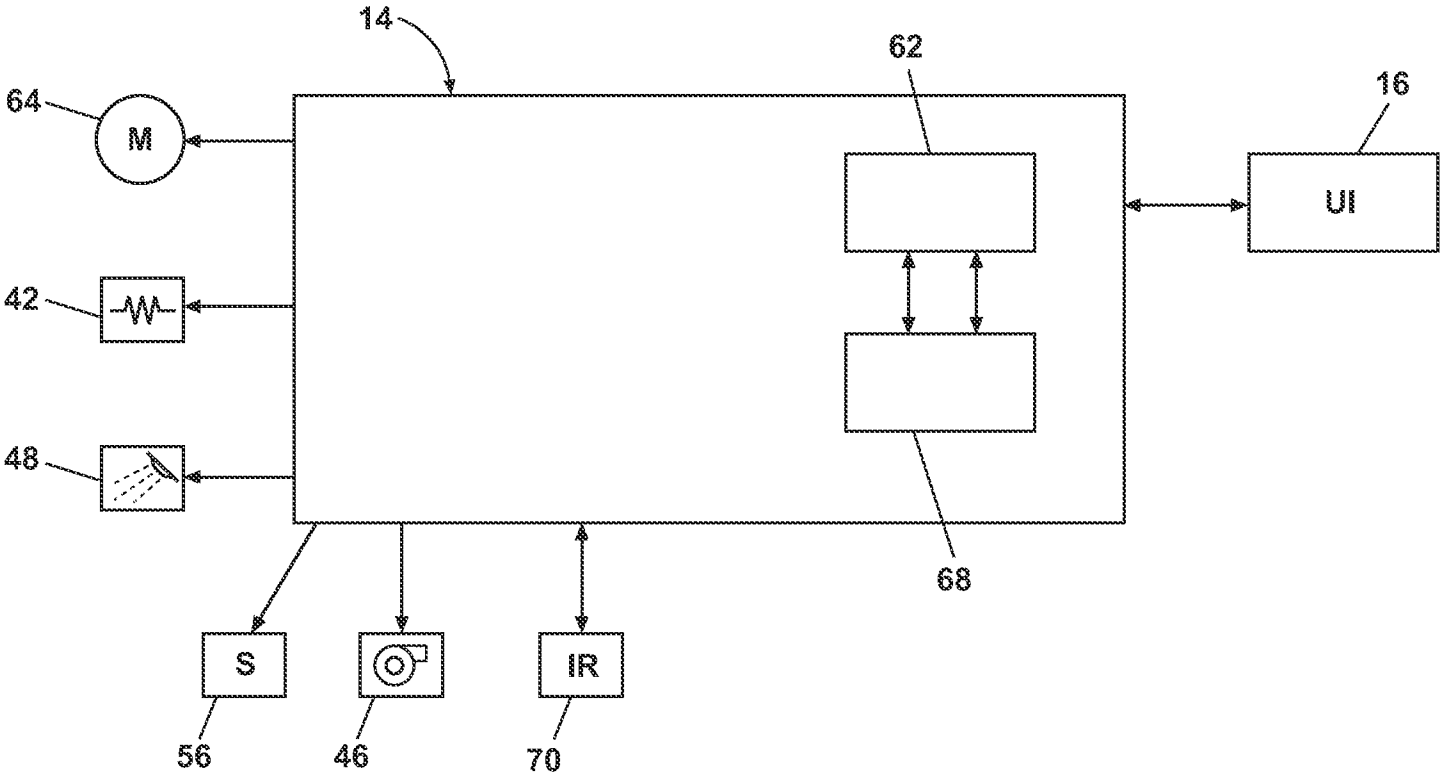
FIG. 5 is a schematic representation of a controller for controlling the operation of one or more components of the clothes dryer of FIG. 1.

As illustrated in FIG. 5, the controller 14 may be provided with a memory 62 and a central processing unit (CPU) 68. The memory 62 may be used for storing the control software that may be executed by the CPU 68 in completing a cycle of operation using the clothes dryer 10 and any additional software. The memory 62 may also be used to store information, such as a database or table, and to store data received from the one or more components of the clothes dryer 10 that may be communicably coupled with the controller 14.

The controller 14 may be communicably and/or operably coupled with one or more components of the clothes dryer 10 for communicating with and controlling the operation of the component to complete a cycle of operation. For example, the controller 14 may be coupled with the heating element 42 and the blower 46 for controlling the temperature and flow rate through the treatment chamber 34; the motor 64 for controlling the direction and speed of rotation of the drum 28; the dispensing system 48 for dispensing a treatment chemistry during a cycle of operation; and the user interface 16 for receiving user selected inputs and communicating information to the user.

The controller 14 may also receive input from various sensors 56, which are known in the art and not shown for simplicity. Non-limiting examples of sensors 56 that may be communicably coupled with the controller 14 include: an inlet air temperature sensor, an exhaust air temperature sensor, a moisture sensor, an air flow rate sensor, a weight sensor, and a motor torque sensor.

The controller 14 may also be coupled with the IR sensor 70 to receive temperature information from the IR sensor 70. The temperature readings may be sent to the controller 14 and analyzed using analysis software stored in the controller memory 62 to determine a load size of a load of laundry within the drum 28. The controller 14 may use the determined load size to set one or more operating parameters of at least one component with which the controller 14 is operably coupled with to complete a cycle of operation. The determined load size of the load may include at least one of extra-small, small, medium, large, and extra-large, although other qualitative and/or quantitative load sizes may be used, including, but not limited to those based on weight or number of articles, or any combination thereof.

The previously described clothes dryer 10 provides the structure necessary for the implementation of the method of the invention. Several embodiments of the method will now be described in terms of the operation of the clothes dryer 10. The embodiments of the method function to automatically determine the load size of a load of laundry and control the operation of the clothes dryer 10 based on the determined load size.

The load size of a load of laundry may be determined by using the IR sensor 70 to obtain multiple temperature readings over time of the contents, i.e. the load of laundry, of the drum 28 as the drum 28 is rotating. The load size may then be used to control the operation of the clothes dryer 10.

Controlling the operation of the clothes dryer 10 based on the determined load size may include setting at least one operating parameter of a cycle of operation including a rotational speed of the drum 28, a direction of rotation of the drum 28, a temperature in the treating chamber 34, which may include changing a temperature or heating profile, an air flow through the treating chamber 34, which may include changing the blower speed or profile, an energy profile for the cycle of operation, which may include determining the energy needed to complete the cycle of operation, a cycle or phase time, which may include updating a display on the user interface 16 with the time to complete the cycle of operation or a cycle phase, an operation of the IR sensor 70, an algorithm used by the controller 14, a type of treating chemistry, an amount of treating chemistry, a start or end of cycle condition, and a start or end cycle step condition.

Setting a start or end of cycle condition may include determining when to start or end a cycle of operation. This may include signaling the controller 14 to immediately start or end a cycle of operation or setting a time at which to start or end a cycle of operation.

Setting a start or end of cycle step condition may include determining when to start a step or phase within a given operating cycle or when to end a step within a given operating cycle. This may include signaling the controller 14 to immediately transition from one cycle step to another or setting a time at which to transition from one step to another within a given operating cycle. Examples of cycle steps include rotation with heated air, rotation without heated air, treatment dispensing, and a wrinkle guard step.

Before specific embodiments of the methods are presented, a description of the concepts behind the methods may be constructive. In this discussion, small, medium, and large loads of laundry are referenced; however, it is understood that other qualitative load size may be used, including, but not limited to, extra-small and extra-large loads. It is also understood that the methods described herein may be adapted for use with quantitative load sizes, including, but not limited to those based on weight, number of articles, or any combination thereof.

Throughout a cycle of operation in the clothes dryer 10, the temperature of the load of laundry sensed by the IR sensor 70 varies. The temperature variation may exist for several reasons. One may be that the IR sensor 70 has a fixed field of view. The tumbling of the load as the drum 28 rotates results in a continuous change in the amount of laundry and the specific laundry items within the field of view of the IR sensor 70. Not all items of laundry nor all portions of a single item of laundry have the same temperature. Therefore, the temperature sensed by the IR sensor 70 may vary from reading to reading, even if the overall average temperature of the load does not significantly change. The tumbling of the load as the drum 28 rotates also results in a continuous change in the portion of the surrounding drum 28 within the field of view of the IR sensor 70. The temperature of the drum 28 may not always be the same as the temperature of the load of laundry. Collectively, the changing portions of the load and drum 28 in the field of view may cause temperature variations.

Furthermore, portions of the cycle of operation may have distinctive effects on the temperature of the load. Dispensing a treating chemistry onto a load of laundry may affect the temperature since the treating chemistry is typically at a temperature lower than the temperature of the load, resulting in a cooling of the portion of the load contacted by the treating chemistry. The treating chemistry may also migrate thorough the load to cool additional portions of the load. The treating chemistry may also evaporate resulting in evaporative cooling of that portion of the load. Different portions of the load that have been exposed to the treating chemistry may have a different temperature than those portion of the load that have not, and as these different portions move in and out of the field of view of the IR sensor 70, the temperature will vary. Drying the load of laundry will also affect the temperature. As the load of laundry dries, the temperature of the load becomes more consistent throughout the load, which may lead to less temperature variation.

Figure 6:
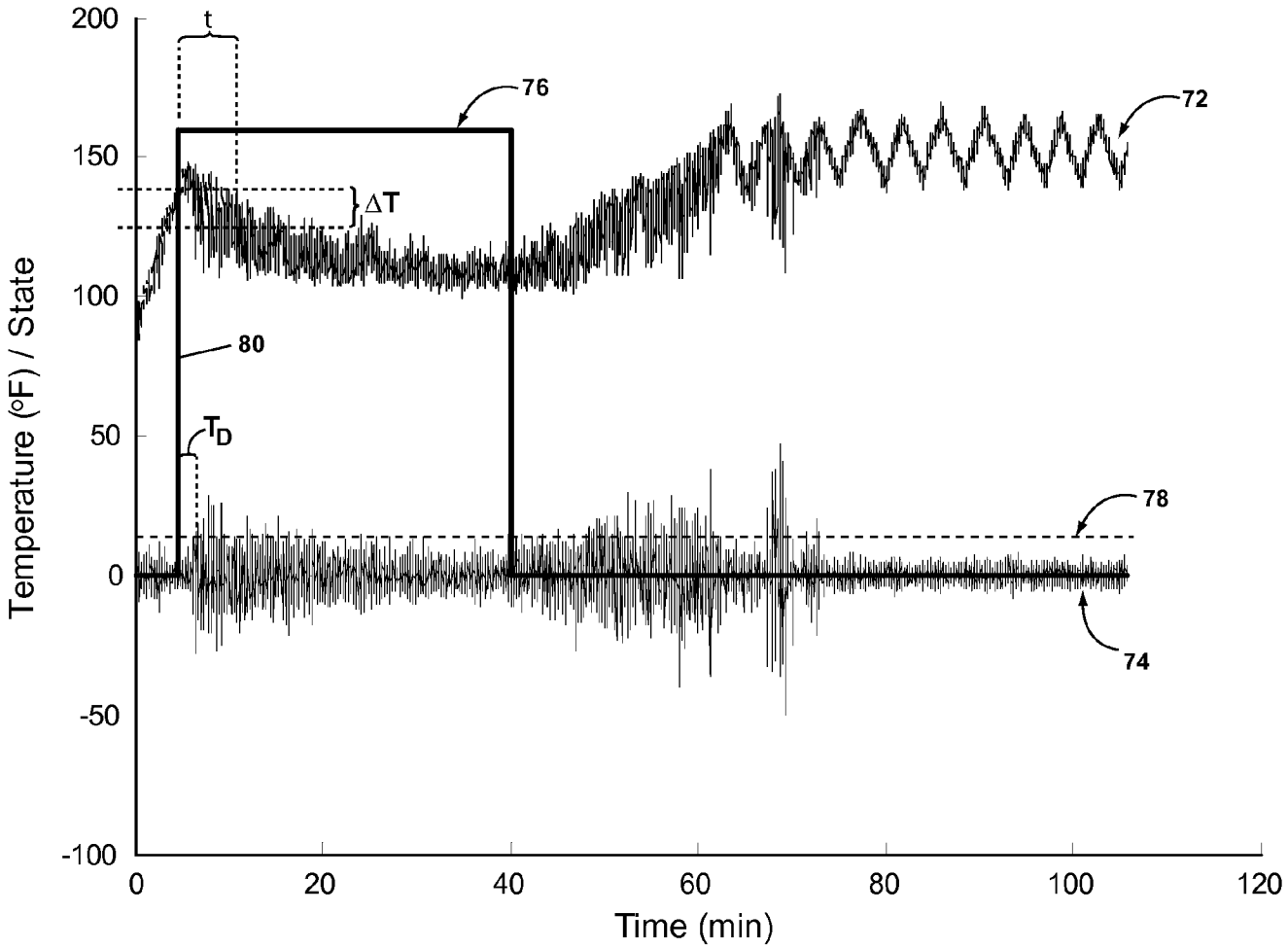
FIG. 6 is a graph of the temperature and dispensing state over time of a large load of laundry during tumbling in a clothes dryer, wherein the temperature is measured by an IR sensor and the dispensing state indicates when a dispenser is dispensing a treating chemistry.

FIG. 6 shows a graph of the temperature of a large load of laundry and the dispensing state over time during a cycle of operation in the clothes dryer 10, wherein the temperature is measured by the IR sensor 70 and the dispensing state indicates when the dispenser 50 is dispensing a treating chemistry. While the graph is compiled using data from a large load, it is understood that similar data can be compiled for other load sizes, such as small and medium loads.

In the graph, line 72 represents the temperature sensed by the IR sensor 70, line 74 represents the temperature variation, and line 76 represents the dispensing state, for which a value other than zero indicates that treating chemistry is being dispensed. In the example shown, the temperature variation 74 is the difference between consecutive readings of the IR sensor 70. From the graph, a delay time $T_D$ can be determined, which is the amount of time it takes for the temperature variation 74 to satisfy a predetermined threshold value, represented by line 78, from the start of dispensing, indicated at 80. The threshold value 78 may be determined from experimental data or may be chosen through a user selection via the user interface 16 prior to or at the start of a cycle of operation. It is expected that the threshold value 78 may vary between different dryer platforms and will be selected based on the performance of a given dryer platform to ensure that the threshold value 78 is sufficient to correctly determine the delay time $T_D$. The delay time $T_D$ corresponds to the first big change in the temperature 72, and can be determined by comparing the absolute value of temperature variation 74 to the threshold value 78; the time it takes for the absolute value of the temperature variation 74 to reach the threshold value 78 is the delay time $T_D$.

After the start of dispensing 80, the temperature 72 will decrease as the dispensed treating chemistry contacts the load. From the graph, a temperature change after dispensing is initiated can be determined. The temperature 72 can be monitored for a given period of time t after the start of dispensing 80, and the initial change or variation in temperature during that time is the temperature change ΔT. Specifically, the temperature change ΔT is found by subtracting the temperature 72 at the start of dispensing 80 from the temperature 72 at time t after the start of dispensing 80. A negative temperature change ΔT indicates that the temperature 72 has decreased in the given period of time t. Some loads may have a positive temperature change ΔT since the temperature of the load may continue to increase after dispensing has begun. This may be more common for larger loads, since the treating chemistry needs more time to migrate through the load to cool the load. The period of time t may have an effect on whether the temperature change ΔT is positive or negative since most if not all loads, regardless of size, will eventually decrease in temperature after the start of dispensing 80. For example, the temperature change ΔT for the large load of FIG. 6 is negative for a period of time t that is approximately five minutes. However, for a shorter period of time t, for example, a period of 30 seconds after dispensing is initiated, the large load may have a positive temperature change ΔT. The period of time t may be any suitable time that provides a meaningful result for the given clothes dryer. It is expected that the period of time t may vary between different dryer platforms and will be selected based on the performance of a given dryer platform to ensure that the time t is long enough to pick up a meaningful temperature change ΔT.

Figure 7:
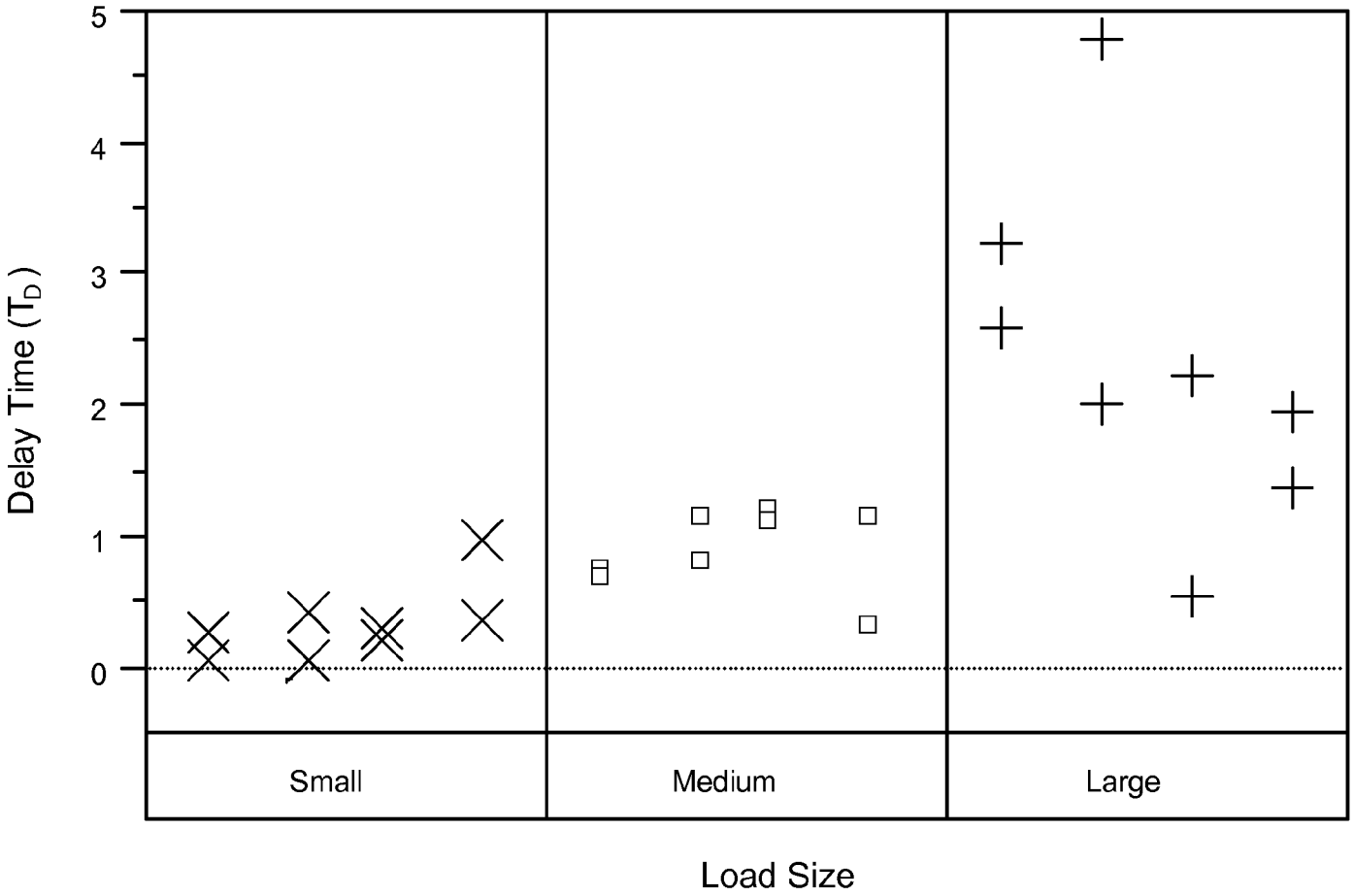
FIG. 7 is a graph of the delay time for a small, medium, and large load of laundry in a clothes dryer.

FIG. 7 shows the delay time $T_D$ for a small, medium, and large load of laundry as determined using temperature readings from an IR sensor. Each point on the graph represents one cycle of operation with the associated load. Some of the variability in the delay time $T_D$ for each load is related to the variability in the testing conditions, such as the voltage supply and the simulated flow restriction.

As can be seen, the larger load of laundry has a higher delay time $T_D$ than either the small or medium loads. The delay times $T_D$ for the small and medium loads are relatively close in value. It can be generally concluded that as load size increases, the delay time $T_D$ increases, although the behavior appears to be strongest for larger loads.

Figure 8:
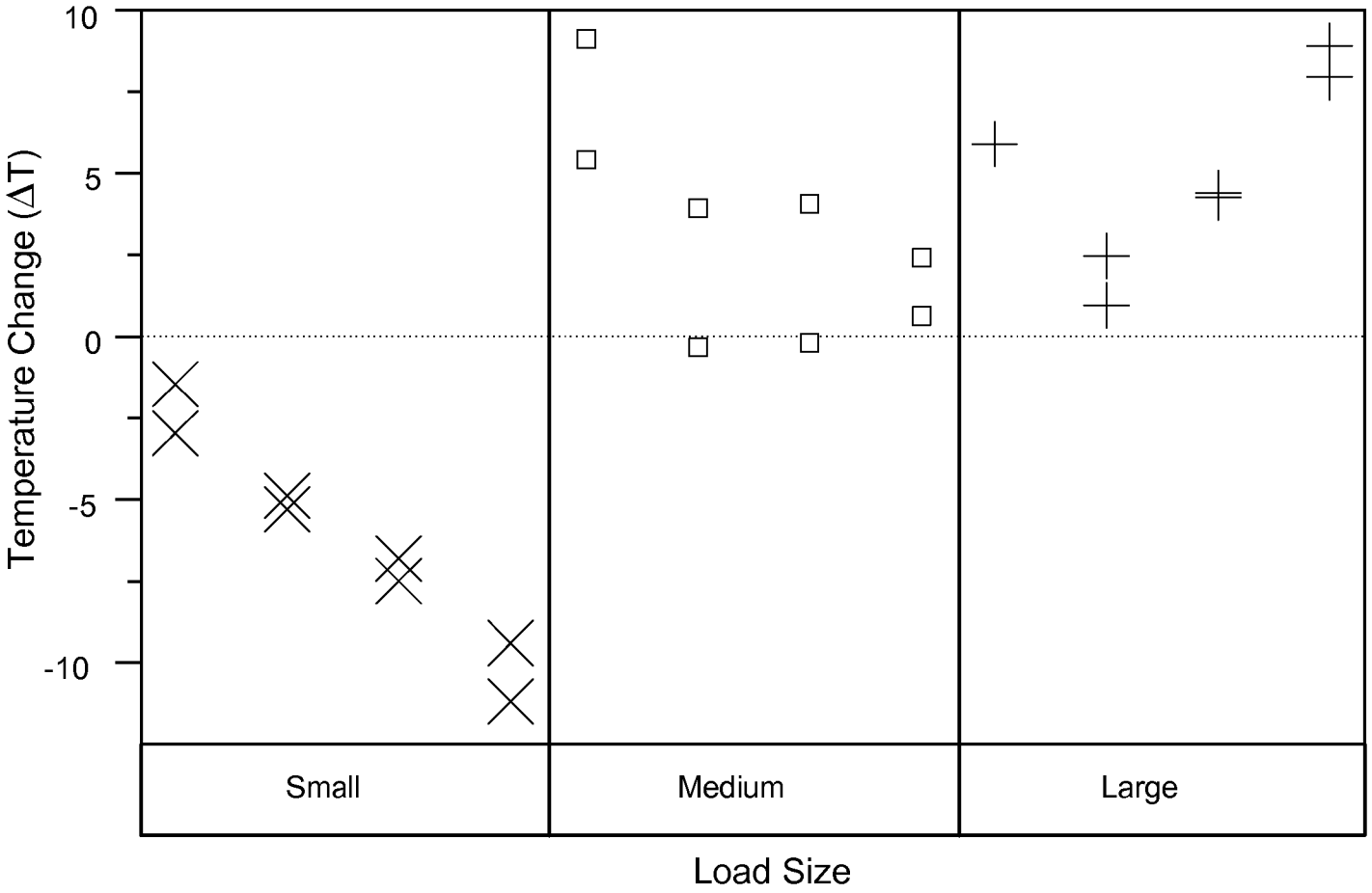
FIG. 8 is a graph of the initial temperature change ($\Delta T$) of a small, medium, and large load of laundry in a clothes dryer after dispensing is initiated.

FIG. 8 shows the temperature change ΔT for a small, medium, and large load of laundry 30 seconds after dispensing is initiated as determined using temperature readings from an IR sensor. Each point on the graph represents one cycle of operation with the associated load. Some of the variability in the temperature change ΔT for each load is related to the variability in the testing conditions, such as the voltage supply and the simulated flow restriction.

As can be seen, the small load has a negative temperature change ΔT, while the medium and large loads have a positive temperature change ΔT. This may be due to the increased amount of time it takes for the dispensed treating chemistry to migrate through a larger load. The temperature changes ΔT for the medium and large loads are also relatively close in value. It can be generally concluded that as load size decreases, there is a greater drop in temperature after dispensing, i.e. the temperature change ΔT is a higher negative value, although the behavior appears to be strongest for small loads. While the time period for measuring ΔT in FIG. 8 is 30 seconds after dispensing is initiated, it is understood that other time periods may be used as well.

Thus, the delay time $T_D$ can distinguish a large load from a small or medium load, but will not distinguish between small and medium loads, and the temperature change ΔT can distinguish a small load from a medium or large load, but will not distinguish between medium and large loads. By using both of these values, small, medium, and large loads can be distinguished from one another.

Figure 9:
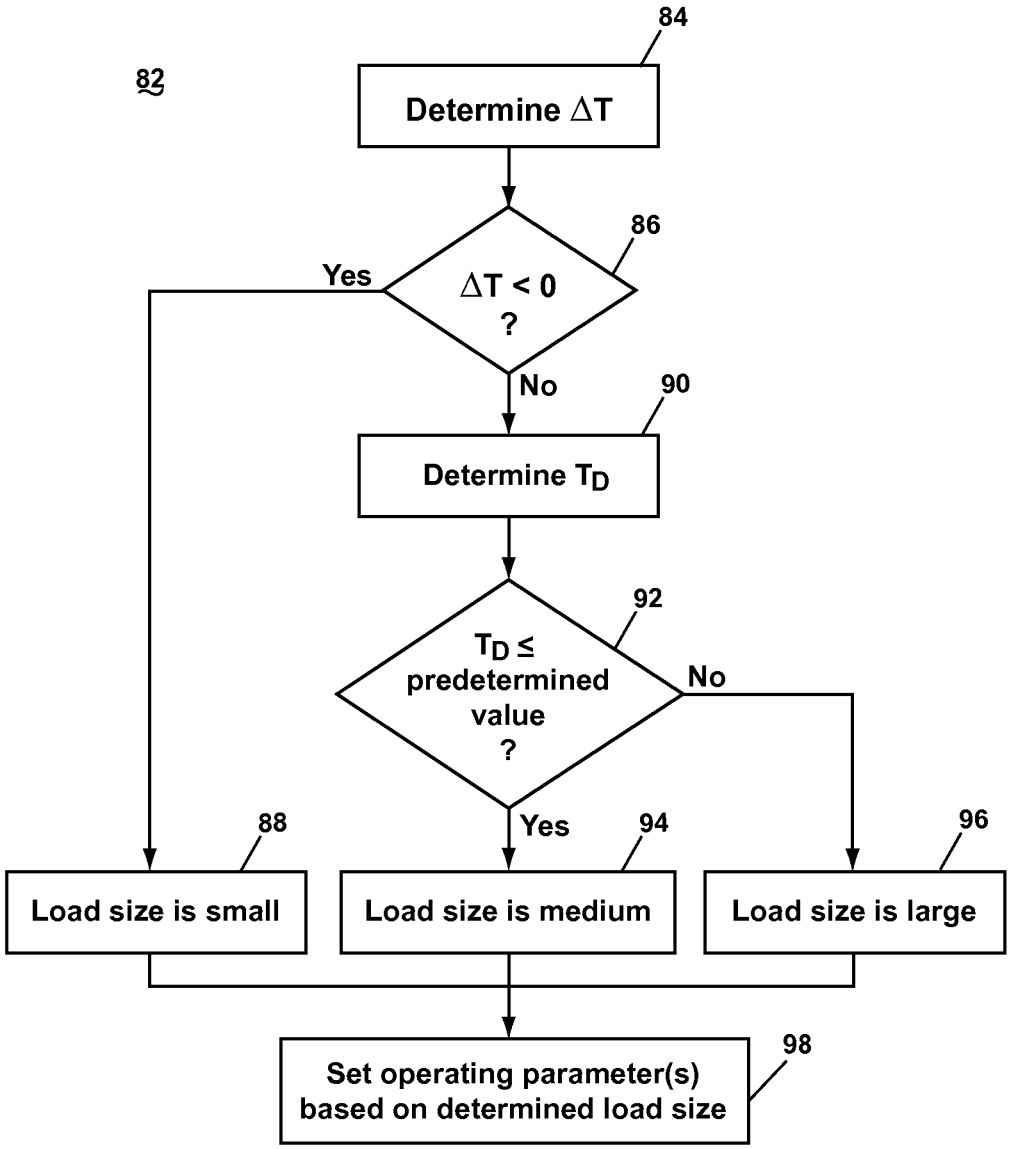
FIG. 9 is a flow chart illustrating a method for determining load size according to one embodiment of the invention.

Referring to FIG. 9, a flow chart of one method 82 of determining load size is shown in accordance with the present invention. The method 82 may be incorporated into a cycle of operation for the clothes dryer 10 and may be carried out by the controller 14 using information from the IR sensor 70. The sequence of steps depicted is for illustrative purposes only and is not meant to limit the method 82 in any way as it is understood that the steps may proceed in a different logical order, additional or intervening steps may be included, or described steps may be divided into multiple steps, without detracting from the invention. For example, in one embodiment of the method 82, the delay time $T_D$ may be determined prior to the temperature change ΔT.

The method 82 may begin at 84 with determining the temperature variation after dispensing has started, or temperature change ΔT. It is assumed that a dispensing phase of the cycle of operation has already begun at the start of the method 82 and that the drum 28 is rotating. At this time, heated air may or may not be supplied to the drying chamber 34. Determining the temperature change ΔT may include taking a plurality of temperature readings over time of the load of laundry with the infrared sensor 70 while the drum 28 is rotating. The drum 28 may be rotated at a rotational speed to tumble the load of laundry within the drying chamber 34. If heated air is supplied, it may be provided for a time sufficient for the load of laundry to reach a uniform temperature. This may be done prior to taking any temperature readings.

The temperature readings may be taken at a predetermined sampling rate to form a plurality of consecutive temperature values. Determining the temperature change ΔT may comprise determining the difference between the plurality of consecutive temperature values. The difference between the plurality of consecutive temperature values may be determined sequentially.

At 86 the temperature change ΔT is determined to a positive or negative value. If the temperature change ΔT is less than zero, the method 82 proceeds to 88 and it is concluded that the load size is small. No other determinations need be made.

At 86, if the temperature change ΔT is not less than zero, i.e. if the temperature change ΔT is equal to or greater than zero, the method 82 proceeds to 90 and the delay time $T_D$ can be measured. As discussed above, the delay time $T_D$ is the time it takes for the temperature variation to exceed a predetermined threshold in response to the dispensing or spraying of treating chemistry on the load.

At 92, if the delay time $T_D$ is less than or equal to than a predetermined value, the method 82 proceeds to 94 and it is concluded that the load size is medium. If the delay time $T_D$ is greater than the predetermined value or if the delay time $T_D$ is not found within the predetermined delay time, the method 82 proceeds to 96 and it is concluded that the load size is large. After the load size is determined to be small, medium, or large at 88, 94, and 96, respectively, the method 82 may optionally proceed to 98, where the cycle of operation is adjusted based on the determined load size, such as by setting one or more operating parameter(s) for the cycle of operation.

The method 82 can be used to conduct a cycle of operation of the clothes dryer 10. The cycle of operation can include the steps of: (1) rotating the drum 28 with a load of laundry in the treating chamber 34; (2) supplying heated air to the treating chamber 34; (3) conducting a first spraying of fluid into the drum 28 to wet the load of laundry; (4) taking a plurality of temperature readings of the load of laundry with the IR sensor 70 while the drum 28 is rotating and after the initiation of the conducting of the first spraying; (5) determining a temperature variation in the plurality of temperature readings over time; (6) determining a delay time, wherein the delay time is a time it takes for the temperature variation to satisfy a predetermined threshold in response to the first spraying of fluid; (7) determining a load size estimation based on at least one of the temperature variation and the delay time; and (8) setting an operational parameter of the cycle of operation in response to the load size estimation. The supplying of heated air can optionally be conducted for a sufficient time for the load of laundry to reach a uniform temperature prior to the conducting of the first spraying of fluid. The cycle of operation can further optionally include conducting a second spraying of fluid into the drum 28 based on the load size estimation, wherein the supplying of heated air is conducted after the conducting of the second spraying of fluid to dry the load of laundry.

Figure 10:
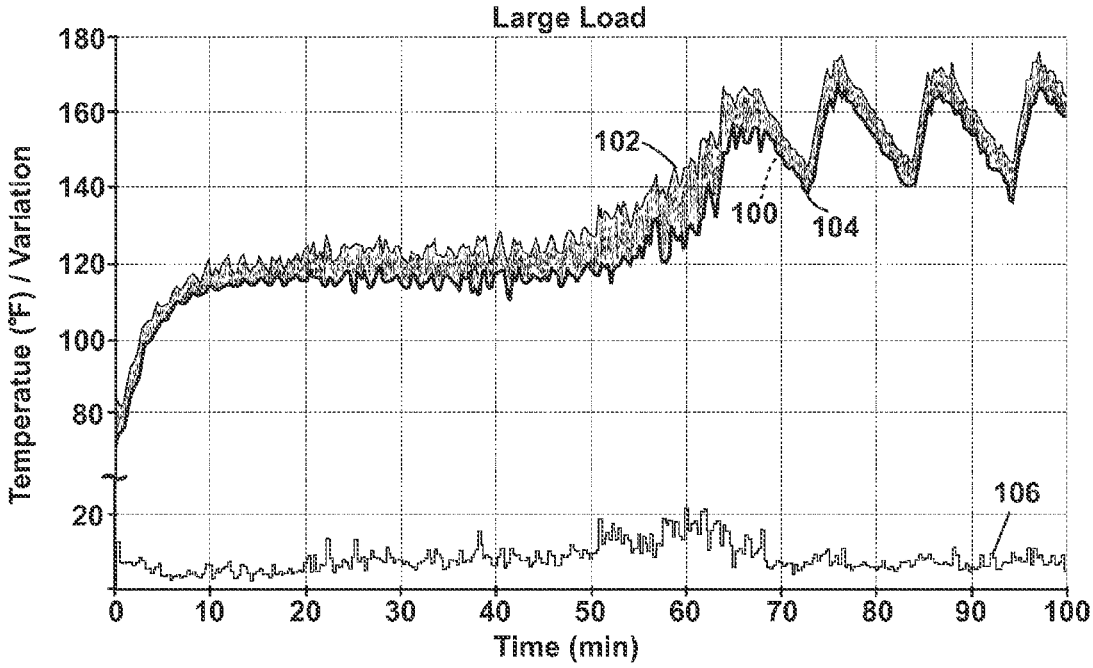
FIG. 10 is a graph of the temperature and the temperature range ($T_R$) over time of a large load of laundry during a cycle of operation in a clothes dryer, wherein the temperature is measured by an IR sensor.
Figure 11:
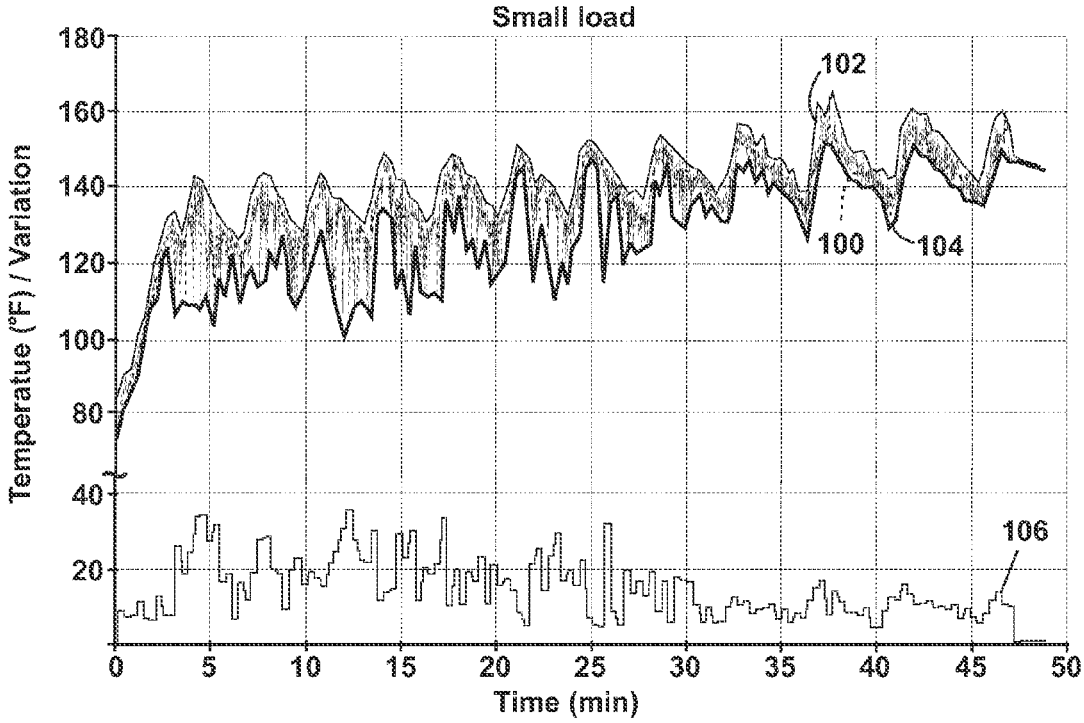
FIG. 11 is a graph of the temperature and the temperature range ($T_R$) over time of a small load of laundry during a cycle of operation in a clothes dryer, wherein the temperature is measured by an IR sensor.

In another embodiment of the invention, temperature variation alone may be used to estimate load size. FIGS. 10 and 11 show graphs of the temperature and the temperature variation over time of a large load of laundry and a small load of laundry, respectively, during a cycle of operation in the clothes dryer 10, wherein the temperature is measured by the IR sensor 70. While the graphs are compiled using data from large and small loads, it is understood that similar data can be compiled for other load sizes, such as a medium load. Furthermore, the example data presented was compiled using a large load consisting of 9 pounds (lbs) of towels and a small load consisting of 1.5 lbs of jeans, but other load sizes, weights and compilations of loads are contemplated.

In each graph, line 100 represents the temperature of the load. An upper envelope, represented by line 102, and a lower envelope, represented by line 104, can be created for the temperature 100. The upper envelope 102 is determined from the maximum values of temperature 100 and the lower envelope 104 is determined from the minimum values of temperature 100. The upper and lower envelopes 102, 104 may be calculated by monitoring the temperature values within a window of time based on a predetermined period, which may be, for example, 20 seconds. The highest value in the window is used as a data point for the upper envelope 102, while the lowest value in the window is used as a data point for the lower envelope 104. This is done for several windows of time to define multiple data points for the upper and lower envelopes 102, 104. The predetermined period may be adjustable since the maximum and minimum temperature values are dependent on the window of time. In the case of a window of 20 seconds, for example, the IR sensor 70 may observe multiple tumbles of the load within its field of view and may have a higher chance of reading the temperature of the hottest area of the load that tumbled. However, if the window is smaller, for example if the window is 0.5 seconds or less, the IR sensor 70 may only be able to read the temperature of the load at a specific point during the tumble pattern since the drum 28 may not make a full rotation in that time.

The difference between the upper and lower envelopes 102, 104 is the temperature variation for the large load over time, and is represented by line 106. It should be noted that while a different technique may be used to determine the temperature variation 74 shown in FIG. 6, both are considered temperature variations for the purposes of this discussion. Further, the temperature change ΔT discussed above for FIGS. 6, 8 and 9 may also be considered a temperature variation for the purposes of this discussion.

When comparing FIGS. 10 and 11, it can be seen that the variation in temperature 100 is relatively small for the large load in comparison to the small load. In general, for the large load, it can be observed that the temperature variation 106 is less than 20 for the majority of the cycle of operation, while the temperature variation 106 for the small load is at or well over 20. From these observations, it can be concluded that the temperature variation 106 for smaller loads of laundry is greater than the temperature variation 106 for larger loads of laundry. One reason for this behavior is that a smaller load may tend to move into and out of the field of view of the IR sensor 70, resulting in greater variation of temperature readings, while a larger load will generally remain in the field of view of the IR sensor 70.

In using temperature variation to distinguish between load sizes, the average temperature variation $T_{VA}$ over a period of time or a maximum temperature variation $T_{VMAX}$ within a period of time can be used. For example, the period of time can be the first five minutes of the cycle of operation. This permits the load size to be determined relatively early in the cycle of operation so that the estimate load size can be used to modify the remainder of the cycle of operation. Alternatively, a separate load size determination cycle could be performed prior to the cycle of operation so that the estimated load size could be used to select or modify the cycle of operation before starting the cycle of operation.

Figure 12:
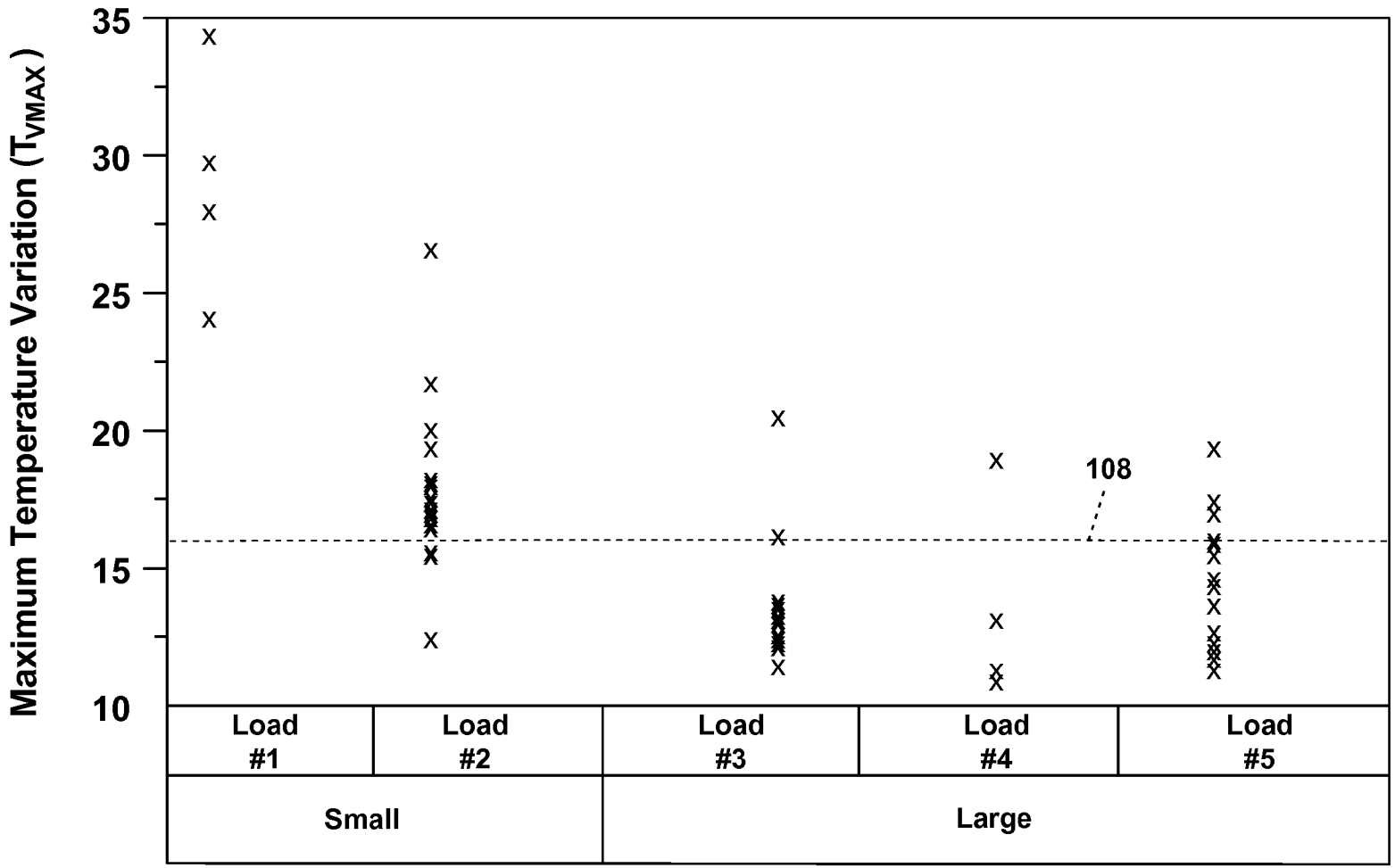
FIG. 12 is a graph of the maximum temperature range ($T_{RMAX}$) within the first five minutes of a cycle of operation in a clothes dryer for different small and large loads of laundry, wherein the temperature is measured by an IR sensor.

FIG. 12 shows a graph of the maximum temperature variation $T_{VMAX}$ within the first five minutes of a cycle of operation in the clothes dryer 10 for different small and large loads of laundry, wherein the temperature is measured by the IR sensor 70. The example data presented was compiled using a two small loads consisting of 1.5 lbs of jeans or towel (Load #1) and 3 lbs of delicate clothing articles (Load #2), and three large loads consisting of 8 lbs of mixed clothing articles (Load #3), 9 lbs of jeans or towels (Load #4), and 12 lbs of mixed clothing articles (Load #5). Each point on the graph represents one cycle of operation with the associated load. Other load sizes, weights and compilations of loads are contemplated.

From the graph, it can be seen that, in general, the maximum temperature variation $T_{VMAX}$ for the small loads (Load #1 and #2) are higher than the maximum temperature variation $T_{VMAX}$ for the large loads (Load #3, #4, and #5). Furthermore, the smaller the load, the higher the maximum temperature variation $T_{VMAX}$ appears to be, since the temperature variation for the smallest load (Load #1) is higher than that for the next smallest load (Load #2). Therefore, the maximum temperature variation $T_{VMAX}$ can be used to distinguish small loads from large loads. Using statistical analysis, a small load threshold 108 can be determined from the data; if a load has a maximum temperature variation $T_{VMAX}$ greater than the threshold value, it is likely that the load is small.

Figure 13:
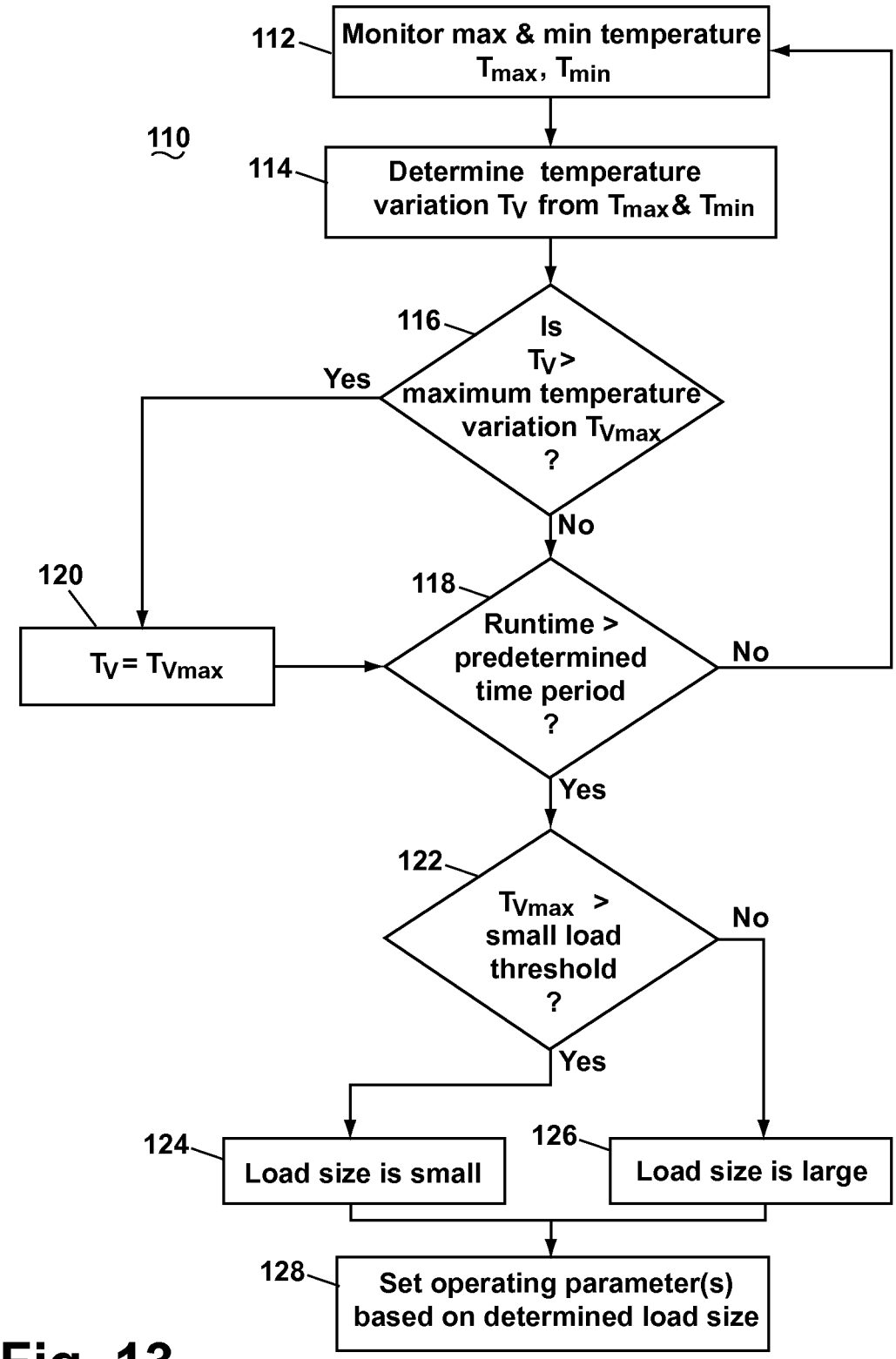
FIG. 13 is a flow chart illustrating a method for determining load size according to another embodiment of the invention.

Referring to FIG. 13, a flow chart of a method 110 of determining load size is shown in accordance with another embodiment of the invention. The method 110 may be incorporated into a cycle of operation for the clothes dryer 10 and may be carried out by the controller 14 using information from the IR sensor 70. The sequence of steps depicted is for illustrative purposes only and is not meant to limit the method 110 in any way as it is understood that the steps may proceed in a different logical order, additional or intervening steps may be included, or described steps may be divided into multiple steps, without detracting from the invention.

The method 110 may begin at 112 with monitoring the maximum and minimum temperature values, $T_{MAX}$ and $T_{MIN}$, i.e. the values used to create the upper and lower envelopes 102, 104 of FIGS. 10 and 11. It is assumed that the cycle of operation has already begun at the start of the method 110 and that the drum 28 is rotating. Monitoring $T_{MAX}$ and $T_{MIN}$ may include taking a plurality of temperature readings over time of the load of laundry with the infrared sensor 70 while the drum 28 is rotating. The drum 28 may be rotated at a rotational speed to tumble the load of laundry within the drying chamber 34. At this time, heated air may or may not be supplied to the drying chamber 34. If heated air is supplied, it may be provided for a time sufficient for the load of laundry to reach a uniform temperature. This may be done prior to taking any temperature readings.

At 114, the temperature variation $T_V$ is determined by subtracting $T_{MIN}$ from $T_{MAX}$. At 116, a comparison is made between the temperature variation $T_v$ and an assumed maximum temperature variation $T_{VMAX}$. The maximum temperature variation $T_{VMAX}$ is the greatest temperature variation $T_V$ found in a predetermined time period, as will be explained below. If the present temperature variation $T_V$ is not greater than the assumed maximum temperature variation $T_{VMAX}$, then the method proceeds directly to 118. If the present temperature variation $T_V$ is greater than the assumed maximum temperature variation $T_{VMAX}$, then the present temperature variation $T_V$ is set as the new assumed maximum temperature variation $T_{VMAX}$ at 120, and then the method proceeds to 118.

At 118, the run time for the method 110 is compared to a predetermined time period. The predetermined time period may be less than the duration of the cycle of operation. For example, the predetermined time period may be five minutes. If the predetermined time period has not been reached, the method 110 returns to 112, and a new temperature variation $T_V$ is determined and compared with the assumed maximum temperature variation $T_{VMAX}$. This continues until the run time reaches or surpasses the predetermined time period, at which time the method proceeds to 122. At this point, the assumed maximum temperature variation $T_{VMAX}$ is confirmed as the actual maximum temperature variation $T_{VMAX}$ since it is the maximum value of temperature variation found in the predetermined time period. The maximum temperature variation $T_{VMAX}$ is compared to a small load threshold. The small load threshold may be a predetermined value determined from data from previous cycles of operation, such as the data presented in FIG. 12 in which the small load threshold is shown as line 108. If the maximum temperature variation $T_{VMAX}$ is greater than the small load threshold, it is concluded that the load size is small at 124. If the maximum temperature variation $T_{VMAX}$ not greater than the small load threshold, it is concluded that the load size is large at 126. After the load size is determined to be small or large at 124 and 126, respectively, the method 110 may optionally proceed to 128, where the cycle of operation is adjusted based on the determined load size, such as by setting one or more operating parameter(s) for the cycle of operation.

The two methods 82 and 110 shown in FIGS. 9 and 13 for determining load size may be combined as well. For example, method 110 may be used first to make a quick initial determination of load size. If the load size is determined to be small, the method of 82 can be used to distinguish whether the load is actually small or if it's close to a medium load. If the load size is determined to be large, the method of 82 can be used to distinguish whether the load is actually large or if it's close to a medium load.

It should be noted that while both methods 82, 110 use temperature variation, the temperature variation of interest for the method 82 is the initial temperature change after dispensing is initiated and the temperature variation of interest for method 110 is the maximum temperature variation during the cycle of operation, or within a predetermined portion of the cycle of operation. The temperature variation for method 110 is not necessarily related to a dispensing phase, and in fact does not require the cycle of operation to have a dispensing phase.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims may be combined with each other in any possible combination, even if the combinations have not been expressly claimed.

What is claimed is:

1. A method for controlling the operation of a clothes dryer having a rotatable drum defining a drying chamber and an infrared temperature sensor directed toward the drying chamber, the method comprising:

taking, with the infrared sensor, a plurality of temperature readings over time of the load of laundry in the drying chamber;

determining a temperature variation in the plurality of temperature readings; and determining a load size estimation based on at least one of the temperature variation and a delay time wherein the delay time is a time it takes for the temperature variation to satisfy a predetermined threshold.

2. The method of claim 1 wherein the taking a plurality of temperature readings comprises taking temperature readings at a predetermined sampling rate to form a plurality of consecutive temperature values.

3. The method of claim 2 wherein the determining of the temperature variation comprises determining the difference between the plurality of consecutive temperature values.

4. The method of claim 3 wherein the determining of the difference between the plurality of consecutive temperature values comprises sequentially determining the difference between the plurality of consecutive temperature values.

5. The method of claim 1 wherein the determining of the delay time comprises determining a time it takes for the temperature variation to exceed the predetermined threshold in response to the spraying of a fluid on the laundry load.

6. The method of claim 5 wherein the determining of the delay time comprises determining the time between the initiation of the spraying and the exceeding of the predetermined threshold.

7. The method of claim 1, further comprising adjusting a cycle of operation of the clothes dryer in response to the load size estimation.

8. The method of claim 7 wherein the adjusting the cycle of operation comprises setting an operating parameter for the cycle of operation.

9. The method of claim 8 wherein the at least one of the operating parameters comprises at least one of: a rotational speed of the drum, a direction of rotation of the drum, a temperature in the drying chamber, an air flow through the drying chamber, an energy profile for the cycle of operation, a cycle time, a cycle phase time, an operation of the infrared temperature sensor, an algorithm used by the clothes dryer, a type of treating chemistry, an amount of treating chemistry, a start or end of cycle condition, and a start or end cycle step condition.

10. The method of claim 1, further comprising supplying heated air to the drying chamber.

11. The method of claim 10 wherein the supplying of the heated air is provided for a time sufficient for the load of laundry to reach a uniform temperature.

12. The method of claim 11 wherein the supplying of the heated air occurs prior to the taking of the temperature readings.

13. The method of claim 11 wherein the determining of the load size estimation is based on both the temperature variation and the delay time.

14. The method of claim 13 wherein when the predetermined threshold is satisfied by a delay time greater than the predetermined threshold, it indicates a large load.

15. The method of claim 13 wherein when the predetermined threshold is satisfied by a delay time greater than the predetermined threshold, it indicates a load of about 9 pounds and greater.

16. The method of claim 1 wherein the determining the temperature variation comprises determining the maximum temperature variation.

17. The method of claim 16 wherein the determining the maximum temperature variation comprises determining the maximum temperature variation from consecutive temperature readings for a predetermined time.

18. The method of claim 17 wherein the determining of the load size estimation is conducted as part of a drying cycle of operation and the predetermined time is less than the duration of the drying cycle of operation.

19. The method of claim 16 wherein load size estimation comprises determining whether the maximum temperature variation satisfies a predetermined maximum temperature variation threshold.

20. The method of claim 19 wherein the predetermined maximum temperature variation threshold is indicative of a small load.

21. The method of claim 19 wherein the predetermined maximum temperature variation threshold is indicative of a load of about 1.5 pounds and less.

22. The method of claim 1 wherein the determining the temperature variation comprises determining the difference between a first of the plurality of temperature readings at a first time and a second of the plurality of temperature readings at a second time, later than the first time, to define a temperature change.

23. The method of claim 22 wherein the plurality of temperature readings comprises taking temperature readings at a predetermined sampling rate to form the plurality of temperature readings, and the first and the second of the plurality of temperature readings are not consecutive temperature readings.

24. The method of claim 22 wherein load size estimation comprises determining whether the temperature change satisfies a predetermined temperature change threshold.

25. The method of claim 24 wherein the satisfying of the predetermined temperature change threshold is indicative of a small load.

26. The method of claim 24 wherein the satisfying of the predetermined temperature change threshold is indicative of a load of about 1.5 pounds and less.

27. The method of claim 26 wherein the load size estimation further comprises determining the delay time.

28. The method of claim 27 wherein when the predetermined temperature change threshold is satisfied by a temperature change greater than zero and the predetermined delay time threshold is satisfied, it indicates a medium load.

29. The method of claim 27 wherein when the predetermined temperature change threshold is satisfied by a temperature change greater than zero and the predetermined delay time threshold is satisfied, it indicates a load of about 3 to 8 pounds.

* * * * *